US009895891B2

(12) United States Patent
Kakiuchi

(10) Patent No.: US 9,895,891 B2
(45) Date of Patent: Feb. 20, 2018

(54) METHOD FOR MANUFACTURING LIQUID DISCHARGE APPARATUS AND LIQUID DISCHARGE APPARATUS

(71) Applicant: Brother Kogyo Kabushiki Kaisha, Nagoya-shi, Aichi-ken (JP)

(72) Inventor: Toru Kakiuchi, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/079,192

(22) Filed: Mar. 24, 2016

(65) Prior Publication Data

US 2016/0279943 A1 Sep. 29, 2016

(30) Foreign Application Priority Data

Mar. 24, 2015 (JP) ..... 2015-060429

(51) Int. Cl.
*B41J 2/16* (2006.01)
*B41J 2/14* (2006.01)

(52) U.S. Cl.
CPC ..... *B41J 2/1631* (2013.01); *B41J 2/14233* (2013.01); *B41J 2/161* (2013.01); *B41J 2/1623* (2013.01); *B41J 2/1628* (2013.01); *B41J 2/1645* (2013.01); *B41J 2002/14241* (2013.01); *B41J 2002/14266* (2013.01); *B41J 2002/14491* (2013.01)

(58) Field of Classification Search
CPC ..... B41J 2/1631; B41J 2/14233; B41J 2/161; B41J 2/1623; B41J 2/1645; B41J 2/1628; B41J 2002/14491; B41J 2002/14241; B41J 2002/14266
See application file for complete search history.

(56) References Cited

U.S. PATENT DOCUMENTS

| | | | | |
|---|---|---|---|---|
| 6,375,858 | B1 | 4/2002 | Makigaki et al. | |
| 8,778,599 | B2 | 7/2014 | Uohashi et al. | |
| 9,272,516 | B2 | 3/2016 | Enomoto et al. | |
| 2002/0056698 | A1 | 5/2002 | Makigaki et al. | |
| 2006/0044347 | A1* | 3/2006 | Kwon | B41J 2/1603 347/44 |

(Continued)

FOREIGN PATENT DOCUMENTS

| | | |
|---|---|---|
| JP | H11-28820 A | 2/1999 |
| JP | 3820747 B2 | 9/2006 |

(Continued)

*Primary Examiner* — Justin Seo
(74) *Attorney, Agent, or Firm* — Banner & Witcoff, Ltd.

(57) ABSTRACT

There is provided a method for manufacturing a liquid discharge apparatus including: forming a photoresist film made of a photoresist on a silicon substrate; exposing the photoresist film; forming a nozzle in the photoresist film by exposing the photoresist film and then developing the photoresist film; forming a channel hole in communication with the nozzle by carrying out an etching process from a surface of the substrate on the opposite side from the photoresist film after forming the nozzle; and joining a channel member to the surface of the substrate on the opposite side from the photoresist film, the channel member including a pressure chamber in communication with the channel hole and a piezoelectric element formed as a film to correspond to the pressure chamber.

22 Claims, 12 Drawing Sheets

(56) References Cited

U.S. PATENT DOCUMENTS

| | | | | |
|---|---|---|---|---|
| 2010/0053269 | A1* | 3/2010 | Fujii | B41J 2/1606 347/45 |
| 2012/0236085 | A1* | 9/2012 | Miyata | B41J 2/14233 347/71 |
| 2014/0141379 | A1 | 5/2014 | Uohashi et al. | |
| 2014/0292932 | A1 | 10/2014 | Enomoto et al. | |

FOREIGN PATENT DOCUMENTS

| | | | |
|---|---|---|---|
| JP | 2014-121873 | A | 7/2014 |
| JP | 2014-208447 | A | 11/2014 |

* cited by examiner

NEGATIVE TYPE

POSITIVE TYPE

METHOD FOR MANUFACTURING LIQUID DISCHARGE APPARATUS AND LIQUID DISCHARGE APPARATUS

CROSS REFERENCE TO RELATED APPLICATION

The present application claims priorities from Japanese Patent Application No. 2015-060429 filed on Mar. 24, 2015, the disclosures of which are incorporated herein by reference in its entirety.

BACKGROUND

Field of the Invention

The present disclosure relates to a method for manufacturing liquid discharge apparatus and to a liquid discharge apparatus.

Description of the Related Art

Conventionally, there are publicly known ink jet heads as liquid jet apparatuses which jet ink from nozzles and include a head chip. The head chip has a channel forming plate, a piezoelectric actuator joined to the upper surface of the channel forming plate, and a silicon nozzle plate joined to the lower surface of the channel forming plate. A plurality of nozzles are formed in the nozzle plate. A plurality of pressure chambers are formed in the piezoelectric actuator member to communicate respectively with the plurality of nozzles via channels formed in the channel forming plate. The head chip jets the ink from the nozzles in respective communication with the pressure chambers by bringing about a pressure change in the ink inside the respective pressure chambers in the piezoelectric actuator member.

SUMMARY

In one of the conventional ink jet heads, the nozzle plate of the head chip is formed of silicon and joined to a channel substrate in which the channels are formed to correspond to the nozzles. In this case, because it is possible to form the nozzles through an etching process capable of processing the silicon substrate with high precision, it is possible to heighten the precision of the position and/or shape of each of the nozzles and channels. Especially, such a nozzle plate is preferred for small arrayal pitch of the nozzles (200 dpi or more, for example). However, this kind of nozzle plate uses a plurality of expensive silicon substrates and, in order to form deep shaped nozzles, the manufacturing cost is also increased.

It is an object of the present teaching to provide a method for manufacturing a liquid discharge apparatus and such liquid discharge apparatus capable of forming the nozzles with high precision while suppressing the cost.

According to a first aspect of the present teaching, there is provided a method for manufacturing a liquid discharge apparatus including:

forming a photoresist film made of a photoresist on a silicon substrate;

exposing the photoresist film;

forming a nozzle in the photoresist film by exposing the photoresist film and then developing the photoresist film;

forming a channel hole in communication with the nozzle by carrying out an etching process from a surface of the substrate on the opposite side from the photoresist film after forming the nozzle; and joining a channel member to the surface of the substrate on the opposite side from the photoresist film, the channel member including a pressure chamber in communication with the channel hole and a piezoelectric element formed as a film to correspond to the pressure chamber.

According to the method for manufacturing the liquid discharge apparatus of the present teaching, first, the photoresist film is formed on the silicon substrate. Next, the nozzle is formed in the photoresist film by using a developer to dissolve and remove part of the photoresist film after exposing the photoresist film. Then, the etching process is carried out to form the channel hole in communication with the nozzle. Further, the channel member formed with the piezoelectric element is joined to the substrate.

According to a second aspect of the present teaching, there is provided a liquid discharge apparatus configured to discharge liquid including:

a silicon substrate in which a channel hole is formed;

a film which is made of a photoresist, arranged on the substrate, and formed with a nozzle in communication with the channel hole;

a channel member which includes a pressure chamber in communication with the channel hole, and is joined to a surface of the substrate on the opposite side from the film; and a piezoelectric element formed in the channel member to correspond to the pressure chamber.

The photoresist for forming the photoresist film to form the nozzle therein is a significantly less expensive material than silicon. Further, it is possible to form a high precision pattern for nozzles at low cost through ordinarily performed exposing and developing steps in a semiconductor process. Therefore, when forming the nozzles at a narrow or small pitch, it is still possible to form the respective nozzles with high precision while keeping down the cost.

BRIEF DESCRIPTION OF THE DRAWINGS

FIGS. 7A to 7E show steps of manufacturing the head unit, wherein FIG. 7A shows the step of forming an inorganic film, FIG. 7B shows the step of forming a resist film, FIG. 7C shows the exposure step, FIG. 7D shows the step of forming nozzles, and FIG. 7E shows the step of forming a water repellent film;

FIGS. 8A to 8D show other steps of manufacturing the head unit, wherein FIG. 8A shows the step of joining a support member, FIG. 8B shows the abrasion step, FIG. 8C shows the step of forming a mask, and FIG. 8D shows the step of forming channel holes by way of etching;

FIGS. 9A to 9E show still other steps of manufacturing the head unit, wherein FIG. 9A shows the step of removing the mask, FIG. 9B shows the step of removing the inorganic film, FIG. 9C shows the step of removing the water repellent film, FIG. 9D shows the step of joining another channel substrate, and FIG. 9E shows the step of detaching support member;

FIGS. 13A to 13E show steps of manufacturing a head unit according to a modification of the embodiment, wherein FIG. 13A shows the step of forming an inorganic film, FIG. 13B shows the step of forming an adhesion film, FIG. 13C shows the step of forming a resist film, FIG. 13D shows the exposure step, and FIG. 13E shows the step of forming nozzles.

DESCRIPTION OF THE EMBODIMENT

Figure 1:
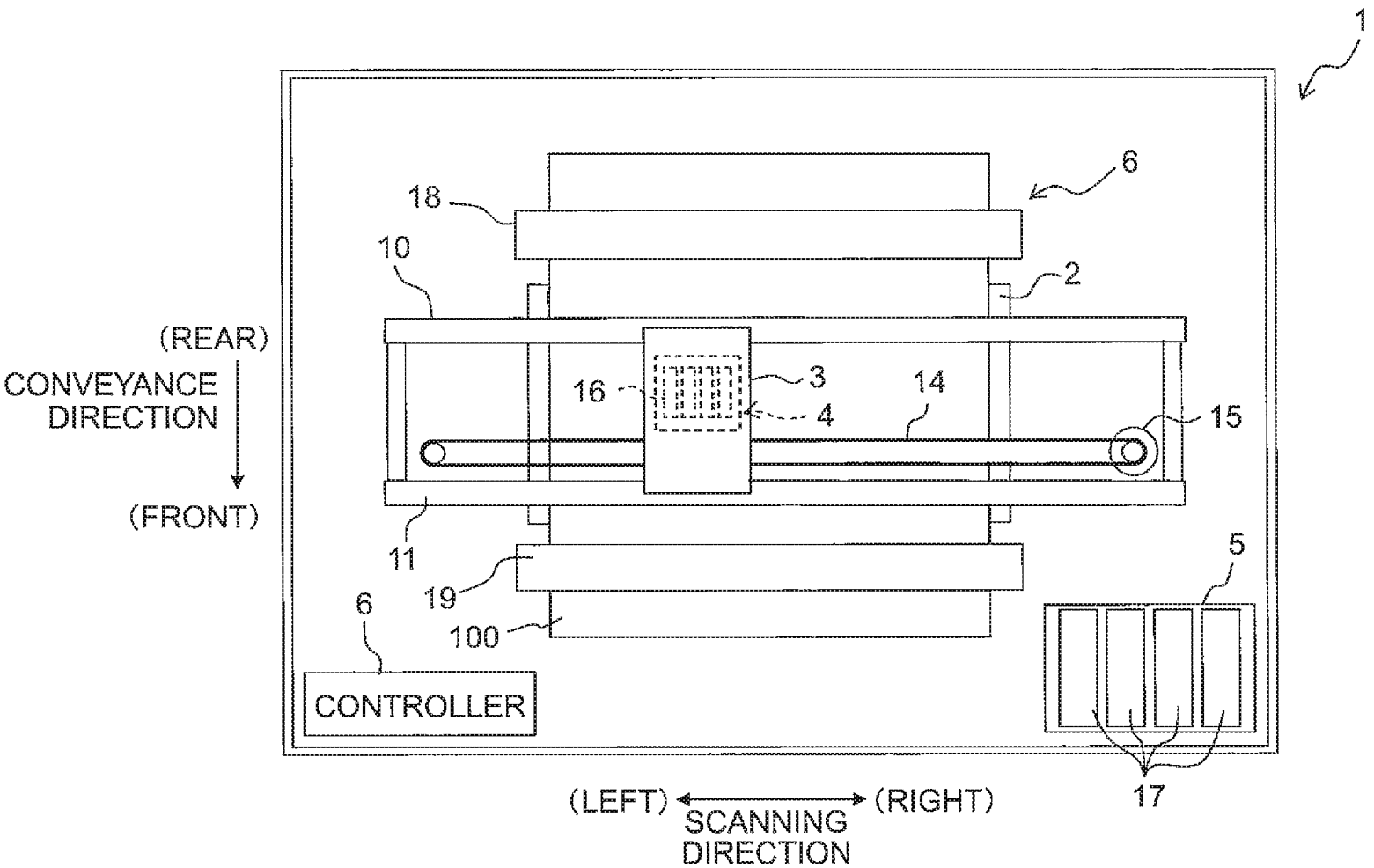
FIG. 1 is a schematic plan view of a printer.

Next, an embodiment of the present teaching will be explained. FIG. 1 is a schematic plan view of a printer according to the embodiment. First, referring to FIG. 1, a schematic configuration of an ink jet printer 1 will be explained. Further, the front, rear, left and right directions depicted in FIG. 1 are defined as "front", "rear", "left" and "right" of the printer, respectively. Further, the near side of the page of FIG. 1 is defined as "upper side" or "upside", while the far side of the page is defined as "lower side" or "downside". The following explanation will be made while appropriately using each directional term of the front, rear, left, right, upside, and downside.

<Schematic Configuration of the Printer>

As depicted in FIG. 1, the ink jet printer 1 includes a platen 2, a carriage 3, an ink jet head 4, a conveyance mechanism 5, a controller 6, etc.

On the upper surface of the platen 2, there is carried a sheet of recording paper 100 which is a recording medium. The carriage 3 is configured to be movable reciprocatingly in a left-right direction (to be also referred to below as a scanning direction) along two guide rails 10 and 11 in a region facing the platen 2. An endless belt 14 is linked to the carriage 3, and a carriage drive motor 15 drives the endless belt 14 whereby the carriage 3 is moved in the scanning direction.

The ink jet head 4 is fitted on the carriage 3 to move in the scanning direction together with the carriage 3. The ink jet head 4 includes four head units 16 aligning in the scanning direction. The four head units 16 are connected, respectively through unshown tubes, with a cartridge holder 7 in which ink cartridges 17 are installed to retain ink of four colors (black, yellow, cyan, and magenta). Each of the head units 16 has a plurality of nozzles 20 (see FIGS. 2 to 5) formed in its lower surface (the surface on the far side of the page of FIG. 1). The nozzles 20 of the respective head units 16 jet the ink supplied from the ink cartridges 17 toward the recording paper 100 carried on the platen 2.

The conveyance mechanism 5 has two conveyance rollers 18 and 19 arranged to interpose the platen 2 therebetween in a front-rear direction. With the two conveyance rollers 18 and 19, the conveyance mechanism 5 conveys the recording paper 100 carried on the platen 2 in a frontward direction (to be also referred to below as a conveyance direction).

The controller 6 is provided with a ROM (Read Only Memory), a RAM (Random Access Memory), an ASIC (Application Specific Integrated Circuit) including various types of control circuits, etc.

Following programs stored in the ROM, the controller 6 uses the ASIC to carry out various processes such as printing on the recording paper 100 and the like. For example, in a printing process, based on a print command input from an external device such as a PC or the like, the controller 6 controls the ink jet head 4, the carriage drive motor 15 and the like to print image and the like on the recording paper 100. In particular, the controller 6 causes those members to alternately carry out an ink jet operation to jet the inks while moving the ink jet head 4 together with the carriage 3 in the scanning direction, and a transport operation to let the transport rollers 18 and 19 transport the recording paper 100 in the transport direction by a predetermined length.

Next, a configuration of the ink jet head 4 will be explained. Further, because the four head units 16 of the ink jet head 4 have exactly the same structure, one of the head units 16 will be explained while the others are omitted from the explanation.

As depicted in FIGS. 2 to 5, the head unit 16 includes a first channel substrate 21, a second channel substrate 22, a nozzle forming film 23, a piezoelectric actuator 24, and a reservoir forming member 25. Further, in order to simplify FIG. 2, only a lineation is drawn with a two-dot chain line to show the reservoir forming member 25 positioned above the first channel substrate 21 and the piezoelectric actuator 24.

(The First Channel Substrate)

The first channel substrate 21 is made of silicon single crystal. A plurality of pressure chambers 26 are formed in the first channel substrate 21. The plurality of pressure chambers 26 are arrayed in the transport direction to form two pressure chamber rows aligning in the scanning direction. Further, the first channel substrate 21 has a vibration film 30 formed to cover the plurality of pressure chambers 26. The vibration film 30 contains silicon dioxide ($SiO_2$) or silicon nitride ($SiN_x$) formed by oxidizing or nitriding part of the surface of the silicon first channel substrate 21. The first channel substrate 21 is, for example, 100 μm thick.

<The Second Channel Substrate>

As with the first channel substrate 21, the second channel substrate 22 is also made of silicon single crystal. In the second channel substrate 22, a plurality of channel holes 27 are formed to penetrate through the second channel substrate 22 so as to communicate respectively with the plurality of pressure chambers 26. An inorganic film 28 containing an inorganic silicon compound is formed on the lower surface of the second channel substrate 22. This inorganic film is made of silicon dioxide ($SiO_2$) or silicon nitride ($SiN_x$) formed by, for example, oxidizing or nitriding part of the surface of the silicon second channel substrate 22. Further, the second channel substrate 22 is, for example, 200 μm thick. Further, the inorganic film 28 is, for example, 100 nm to 1 μm thick.

<The Nozzle Forming Film>

The nozzle forming film 23 is arranged on the inorganic film 28 of the second channel substrate 22. The nozzle forming film 23 is formed of photoresist and, for example, is 30 to 50 μm thick. In the nozzle forming film 23, the plurality of nozzles 20 are formed to communicate respectively with the plurality of channel holes 27 of the second channel substrate 22. As will be described later on, the plurality of nozzles 20 are formed by partially removing the photoresist film through an exposure process and a development process.

Figure 2:
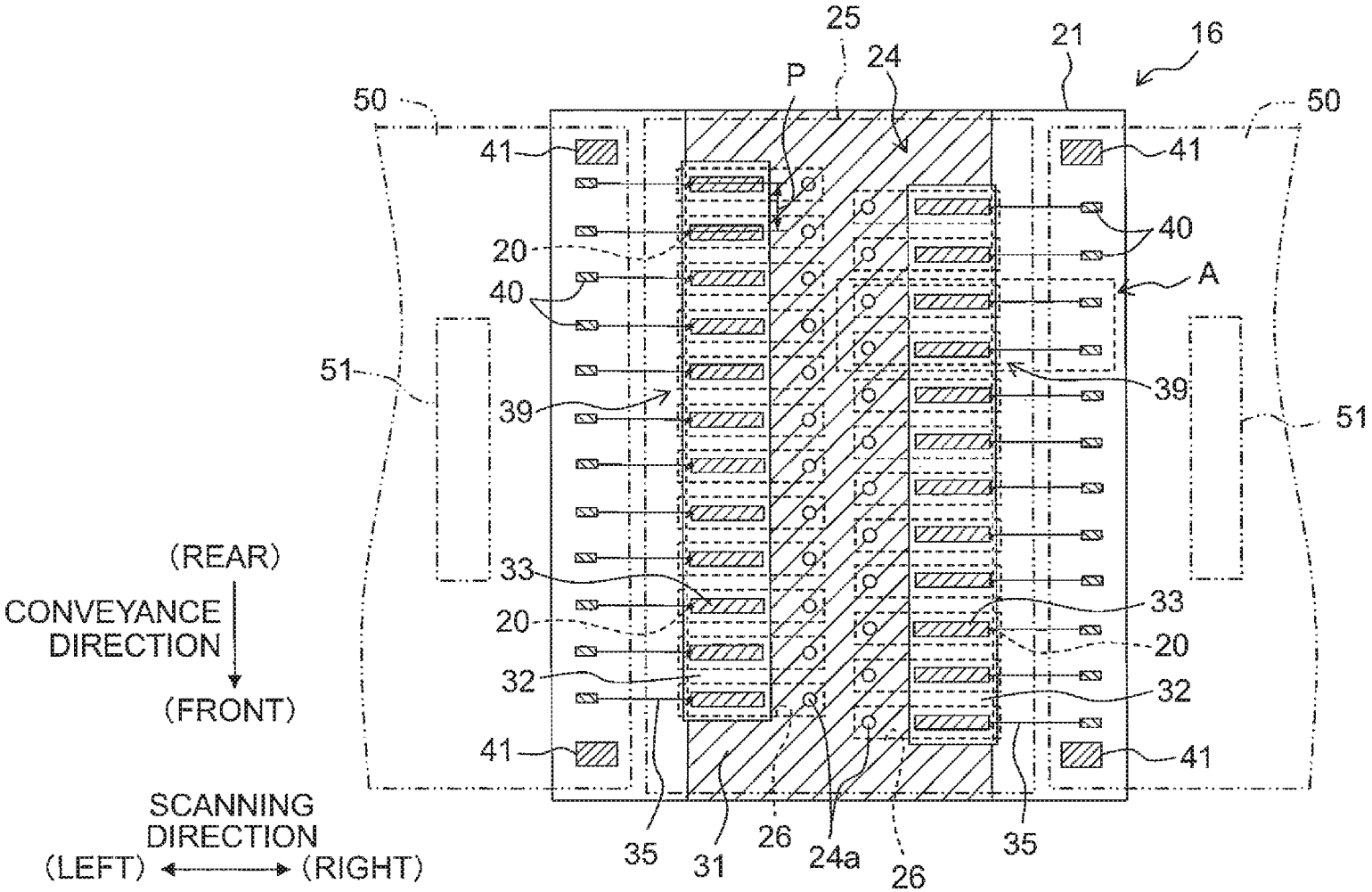
FIG. 2 is a top view of a head unit of an ink jet head.

As depicted in FIG. 2, the plurality of nozzles 20 are arrayed in the transport direction as with the plurality of pressure chambers 26 of the first channel substrate 21, to form two nozzle rows aligning in the scanning direction. The plurality of nozzles 20 of each nozzle row are arrayed, for example, at a small arrayal pitch P such as 200 dpi or above. Between the two nozzle rows, the nozzles 20 deviate in position by half the arrayal pitch P (P/2) for each nozzle row.

Further, on the entire lower surface of the nozzle forming film 23, a liquid repellent film 29 is formed of a liquid repellent material such as fluorine resin or the like. The liquid repellent film 29 is, for example, 100 nm thick or so.

Figure 4:
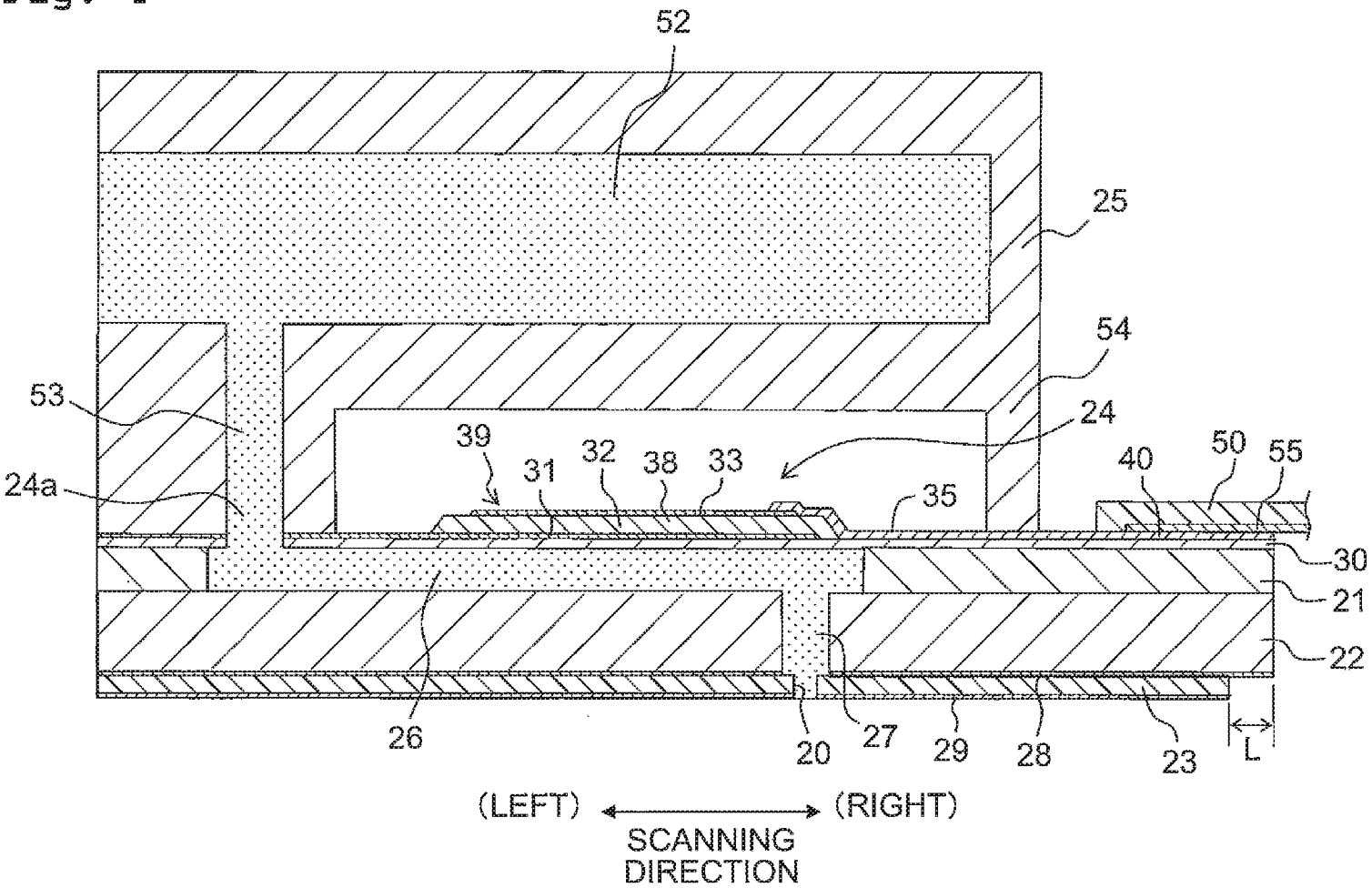
FIG. 4 is a cross-sectional view taken along the line IV-IV of FIG. 3.

Further, as depicted in FIG. 4, the outer edge of the nozzle forming film 23 is, throughout its entire circumference, arranged inside of the outer edge of the second channel substrate 22 by a distance L. For example, L=10 to 20 μm. The reason therefor will be explained later on.

<The Piezoelectric Actuator>

The piezoelectric actuator 24 serves to apply energy for jetting the ink in the plurality of pressure chambers 26 for the respective nozzles 20. The piezoelectric actuator 24 has the vibration film 30, a lower electrode 31 formed on the upper surface of the vibration film 30, piezoelectric bodies 32, upper electrodes 33, etc. As depicted in FIGS. 2 to 5, the piezoelectric actuator 24 includes a plurality of piezoelectric elements 39 arranged on the upper surface of the vibration film 30 to correspond respectively to the plurality of pressure chambers 26 arrayed in two rows. Further, the piezoelectric actuator 24 is also formed with communication holes 24*a* to allow for respective communication between the plurality of pressure chambers 26 and channels inside the reservoir forming member 25.

A configuration of the piezoelectric elements 39 will be explained below. The lower electrode 31 is formed on the upper surface of the vibration film 30 across the plurality of pressure chambers 26. The lower electrode 31 serves as a common electrode for the plurality of piezoelectric elements 39. Being not limited to a particular material, the lower electrode 31 is formed of platinum (Pt), for example.

On the lower electrode 31, the two piezoelectric bodies 32 are arranged to correspond respectively to the two pressure chamber rows. Each one of the piezoelectric bodies 32 has a rectangular shape elongated in the conveyance direction, and is arranged across the plurality of pressure chambers 26 forming the corresponding pressure chamber row. The piezoelectric bodies 32 are formed of a piezoelectric material composed primarily of lead zirconate titanate (PZT) which is a mixed crystal of lead titanate and lead zirconate. Alternatively, the piezoelectric bodies 32 may be formed of non-lead-based piezoelectric material in which no lead is contained.

On the upper surfaces of the piezoelectric bodies 32, the plurality of upper electrodes 33 are formed to correspond respectively to the plurality of pressure chambers 26. The upper electrodes 33 are formed of, for example, platinum (Pt), iridium (Ir), or the like.

In the above configuration, each one of the piezoelectric elements 39 is constructed of one individual electrode 34, such a part of the lower electrode 31 as to face one of the pressure chambers 26, and such a part of the piezoelectric bodies 32 as to face that one of the pressure chambers 26. Further, in one piezoelectric element 39, an active portion 38 will be introduced below to refer especially to such a part of the piezoelectric body 32 as interposed between the corresponding upper electrode 33 and the lower electrode 31.

Wires 35 are connected to the upper electrodes 33 of the respective piezoelectric elements 39. The wires 35 are formed of aluminum (Al), gold (Au), or the like. The wires 35 extend from the upper electrodes 33 in the scanning direction. In more detail as depicted in FIG. 2, the wires 35 connected to the upper electrodes 33 arrayed on the left side extend leftward from the corresponding upper electrodes 33 while the wires 35 connected to the upper electrodes 33 arrayed on the right side extend rightward from the corresponding upper electrodes 33.

Figure 3:
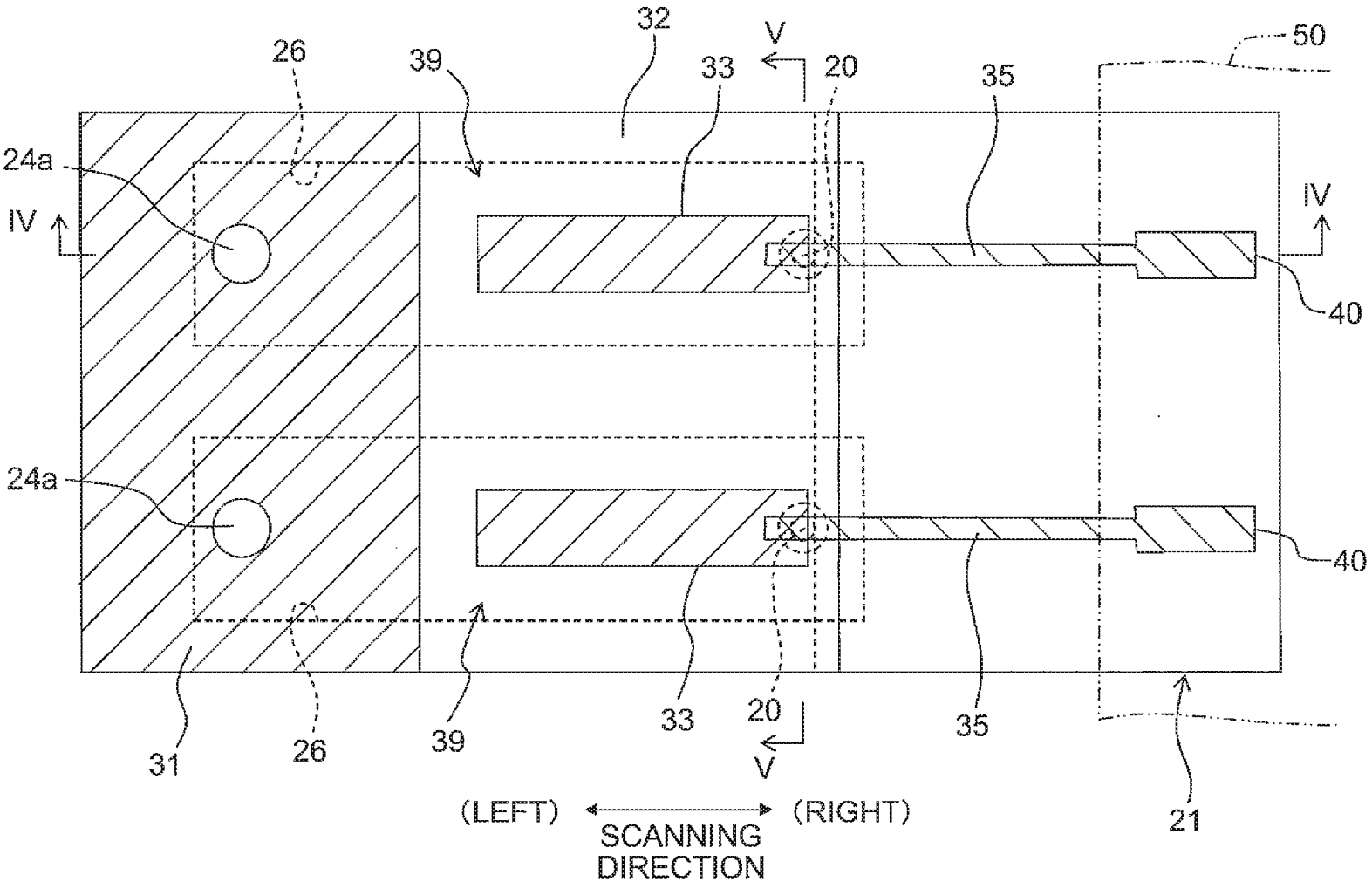
FIG. 3 is an enlarged view of part A of FIG. 2.

As depicted in FIGS. 2 to 4, in left and right two end portions of the first channel substrate 21, a plurality of drive contact portions 40 are arranged to align in the conveyance direction. As depicted in FIG. 2, the wires 35 drawn out leftward from the upper electrodes 33 are connected with the drive contact portions 40 in the left end portion of the first channel substrate 21 while the wires 35 drawn out rightward are connected with the drive contact portions 40 in the right end portion of the first channel substrate 21. Further, in the left and right two end portions of the first channel substrate 21, ground contact portions 41 are also arranged to connect with the lower electrode 31, which is the common electrode, through undepicted wires.

As depicted in FIG. 2, two COFs (Chip On Film) 50, which are wiring members, are joined respectively to the upper surfaces of left and right end portions of the aforementioned piezoelectric actuator 24. As depicted in FIG. 4, a plurality of traces 55 formed in the respective COFs 55 are electrically connected with the plurality of drive contact portions 40, respectively. The controller 6 of the printer 1 (see FIG. 1) is connected to such end portions of the respective COFs 55 as at the other ends than those connected with the drive contact portions 40.

A driver IC 51 is mounted on each of the COFs 50. Based on a control signal sent in from the controller 6, the drivers IC 51 generate and output a drive signal for driving the piezoelectric actuator 24. The drive signal output from the drivers IC 51 is input to the drive contact portions 40 via the traces 55 of the COFs 50 and, furthermore, supplied to each of the upper electrode 33 via the drive traces 35 of the piezoelectric actuator 24. The upper electrodes 33 supplied with the drive signal undergo a potential change between a predetermined drive potential and a ground potential. Further, ground wires (not depicted) are also formed in the COFs 55, and electrically connected with the ground contact portions 41 of the piezoelectric actuator 24. By virtue of this, the lower electrode 31 being connected with the ground contact portions 41 is constantly kept at the ground potential.

Now, an explanation will be made on an operation of the piezoelectric elements 39 when supplied with the drive signal from the drivers IC 51. Without being supplied with the drive signal, the upper electrodes 33 are at the ground potential, that is, at the same potential as the lower electrode 31. From this state, if the drive signal is supplied to any one of the upper electrodes 33 to apply the drive potential to that upper electrode 33, then due to the potential difference between the upper electrode 33 and the lower electrode 31, an electric field is acting on the active portion 38 in a direction parallel to the thickness direction thereof. Here, due to an inverse piezoelectric effect, the active portion 38 extends in the thickness direction so as to contract in the planar direction. Along with the contraction deformation of this active portion 38, the vibration film 30 bows to project toward the pressure chamber 26. By virtue of this, the volume of the pressure chamber 26 decreases to bring about a pressure wave inside the pressure chamber 26, thereby jetting liquid drops of the ink from the nozzle 20 in communication with the pressure chamber 26.

(The Reservoir Forming Member)

Figure 5:
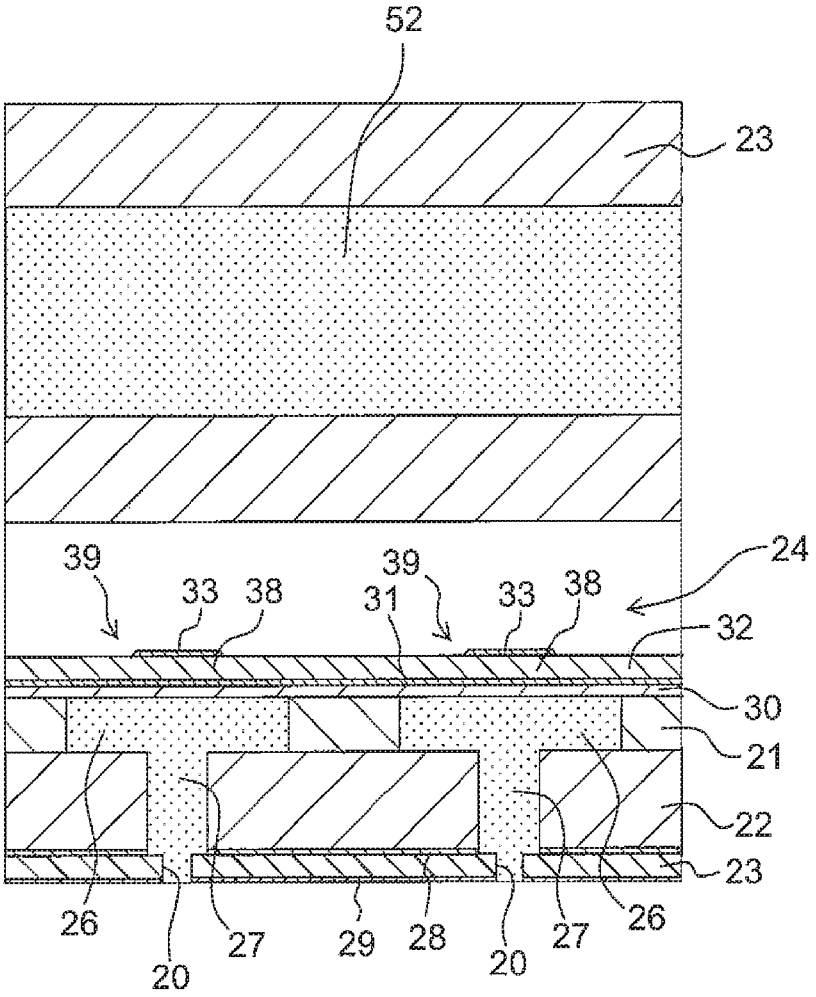
FIG. 5 is a cross-sectional view taken along the line V-V of FIG. 3.

As depicted in FIGS. 4 and 5, the reservoir forming member 25 is arranged on the far side (the upper side) from the first channel substrate 21 across the piezoelectric actuator 24, and joined to the first channel substrate 21 via the piezoelectric actuator 24. While the reservoir forming member 25 may be a silicon substrate as with the first channel substrate 21 and second channel substrate 22, for example, it may also a member formed of a metallic material or a synthetic resin material.

The reservoir forming member 25 has an upper half portion formed with a reservoir 52 extending in the arrayal direction of the pressure chambers 26 (a perpendicular direction to the page of FIG. 4). Through unshown respective tubes, the reservoir 52 is connected with the cartridge holder 7 (see FIG. 1) in which the ink cartridges 17 are installed.

As depicted in FIG. 4, the reservoir forming member 25 has a lower half portion formed with a plurality of ink supply channels 53 extending downward from the reservoir 52. The ink supply channels 53 are in respective communication with the plurality of pressure chambers 26 of the first channel substrate 21 via the plurality of communication holes 24*a* of the piezoelectric actuator 24. By virtue of this, the inks are supplied from the reservoir 52 to the plurality of pressure chambers 26 via the plurality of ink supply channels 53. Further, a cover portion 54 is formed in the lower half portion of the reservoir forming member 25. In the inner space of the cover portion 54, a space is formed to accommodate the plurality of piezoelectric elements 39 of the piezoelectric actuator 24.

Next, an explanation will be made on a method for manufacturing the head units 16 of the ink jet head 4.

Figure 6:
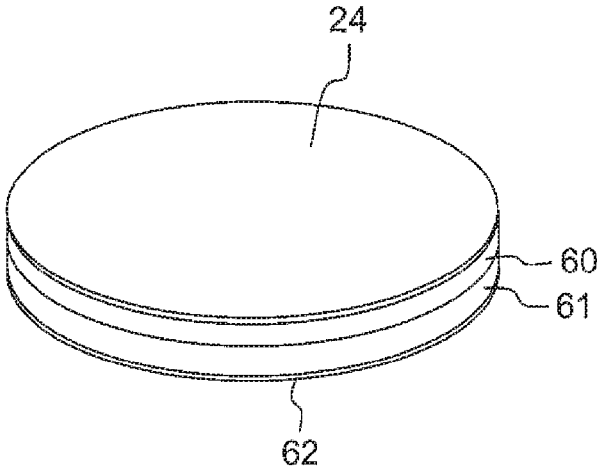
FIG. 6 shows an overlaid state of a silicon substrate to be a first channel substrate and a silicon substrate to be a second channel substrate.

In this embodiment, on one silicon substrate 60, the piezoelectric elements 39 of the plurality of head units 16 are formed as films, and channels are also formed such as the pressure chambers 26 and the like of the plurality of head units 16. On the other hand, on other one silicon substrate 61, a resist film 62 is formed to become the nozzle forming films 23 of the plurality of head units 16, and the channel holes 27 of the plurality of head units 16 are also formed. That is, the first channel substrates 21 of the plurality of head units 16 are formed from the one substrate 60 where the piezoelectric elements 39 are formed respectively. Further, the second channel substrates 22 of the plurality of head units 16 are formed from the other one substrate 61 where the nozzle forming films 23 are formed respectively. After the above step is finished, as depicted in FIG. 6, the two substrates 60 and 61 are overlaid and joined together and, the plurality of head units 16 are separated by singulating the two substrates 60 and 61 with a singulation blade 63 (see FIG. 12).

Referring to FIGS. 7A to 7E through FIGS. 9A to 9E, the following explanation will be focused on, especially, the steps for the substrate 61 where the resist film 62 is formed.

Figure 7A:
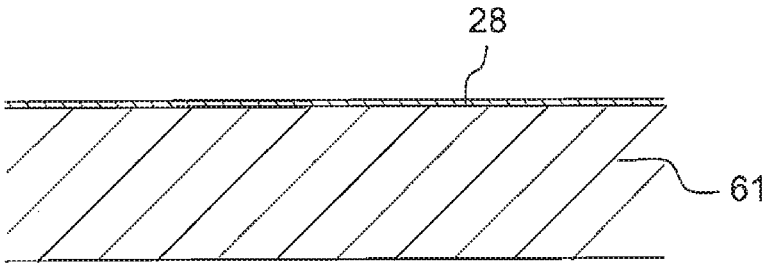

First, as depicted in FIG. 7A, the inorganic film 28 containing an inorganic silicon compound ($SiO_2$, $SiN_x$, or the like) is formed on one surface of the substrate 61 by way of thermal oxidation processing, CVD film forming, or the like.

Figure 7B:
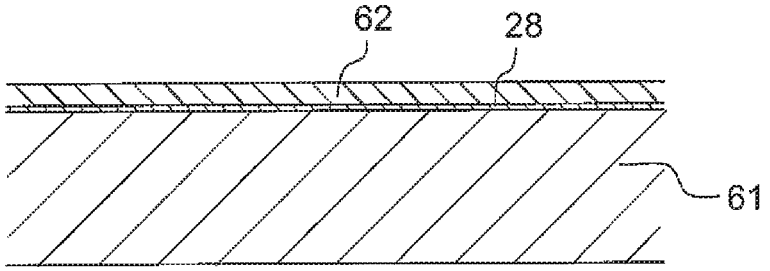

Next, as depicted in FIG. 7B, a liquid photoresist is applied to the inorganic film 28 of the substrate 61 by a publicly known method such as spin coating or the like. Further, while the photoresist comes in negative photosensitive resist and positive photosensitive resist, the negative resist is used here. Further, the liquid photoresist is hardened by heating the substrate 61 to which the photoresist is applied and carrying out a prebake process. By virtue of this, the resist film 62 is formed on the inorganic film 28 of the substrate.

Figure 7C:
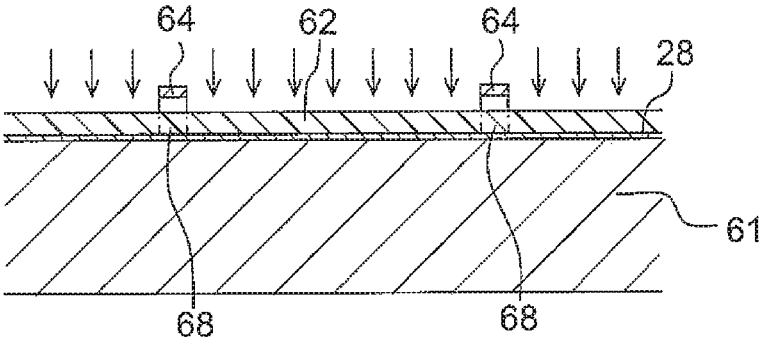
Figure 7D:
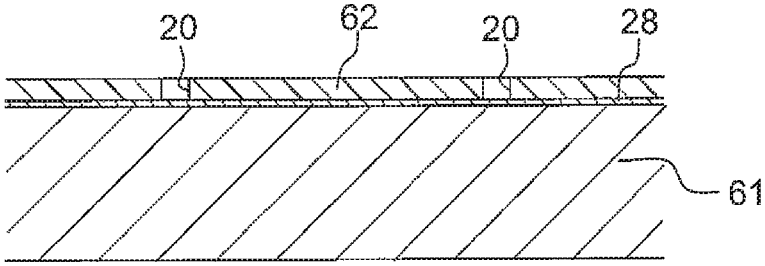

Next, as depicted in FIG. 7C, an exposure machine exposes the resist film 62. In this embodiment, the photoresist used to form the resist film 62 is a negative photosensitive resist. In the negative resist, the exposed part is insoluble in the developer. That is, when photoresist is developed with the developer, the exposed part is not removed but remains. Here, the exposure machine has a mask 64 arranged to cover such parts of the resist film 62 as to form the nozzles 20. After the exposure, by developing the resist film 62 as depicted in FIG. 7D, unexposed parts 68 of the resist film 62 are dissolved and removed with the developer so as to form the nozzles 20. Further, in this embodiment, the plurality of nozzles 20 are arrayed at a small pitch which is 200 dpi or above.

Figure 10A:
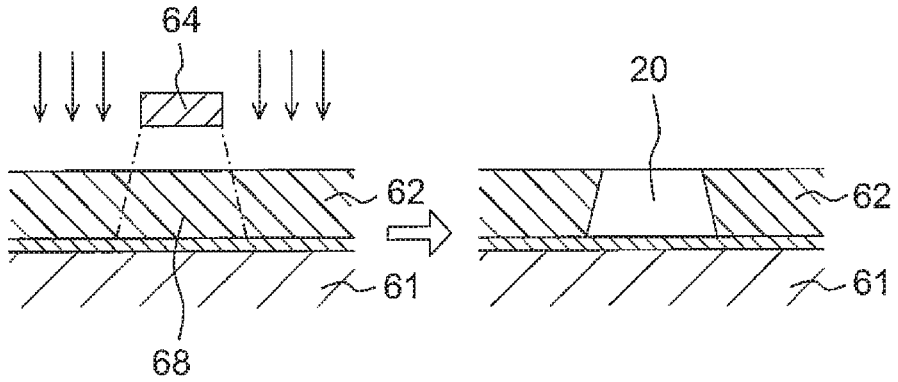
FIGS. 10A and 10B are diagrams for explaining differences between a negative resist and a positive resist.
Figure 10B:
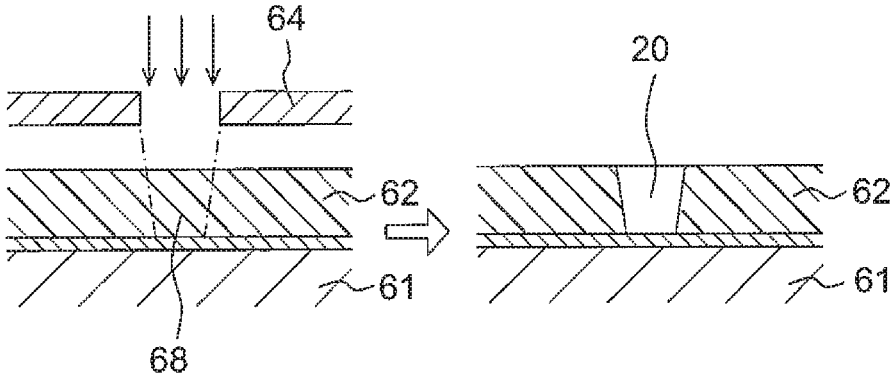

Further, it is also possible to use the positive resist to dissolve and remove its exposed parts. However, for the following reasons, it is possible to use the negative resist. FIGS. 10A and 10B are diagrams for explaining differences between the negative resist and the positive resist.

When the resist film 62 is exposed, on the opposite side from the exposure machine, the light intensity is weaker than the exposure machine side. Hence, the exposed part 68 of the resist film 62 is more likely to shape a narrower exposed area on the side of the substrate 61 (the opposite side from the exposure side). In such a case, because the exposed part 68 remains with the negative resist, as depicted in FIG. 10A, the nozzle 20 has a tapered shape whose hole diameter is narrowed on the opposite side from the substrate 61. In contrast to this, with the positive resist, because the exposed part 68 is removed, which is contrary to the negative resist, as depicted in FIG. 10B, the nozzle 20 has an inverse tapered shape whose hole diameter is greater on the opposite side from the substrate 61 than on the side of the substrate 61. From the point of view of efficiently jetting the ink, there is a problem with such a shape of the nozzle 20. Therefore, by using the negative resist, such problem is avoidable.

Further, it is possible to use a chemically amplified resist as the photoresist to form the resist film 62. Chemically amplified resists have both a high sensitivity and a high resolution. The high sensitivity indicates that the solubility property changes greatly even under a low exposure amount while the high resolution indicates that it is possible to form resist patterns with high precision of shape. The reason for chemically amplified resists to have a high resolution is that the solubility changes steeply with the exposure amount such that there is a great difference in solubility between the part exposed at a predetermined light intensity and the part exposed at a lower light intensity than the predetermined light intensity. Therefore, by forming the resist film 62 with a chemically amplified resist, it is possible to form the nozzles 20 with a high precision of shape.

Figure 11:
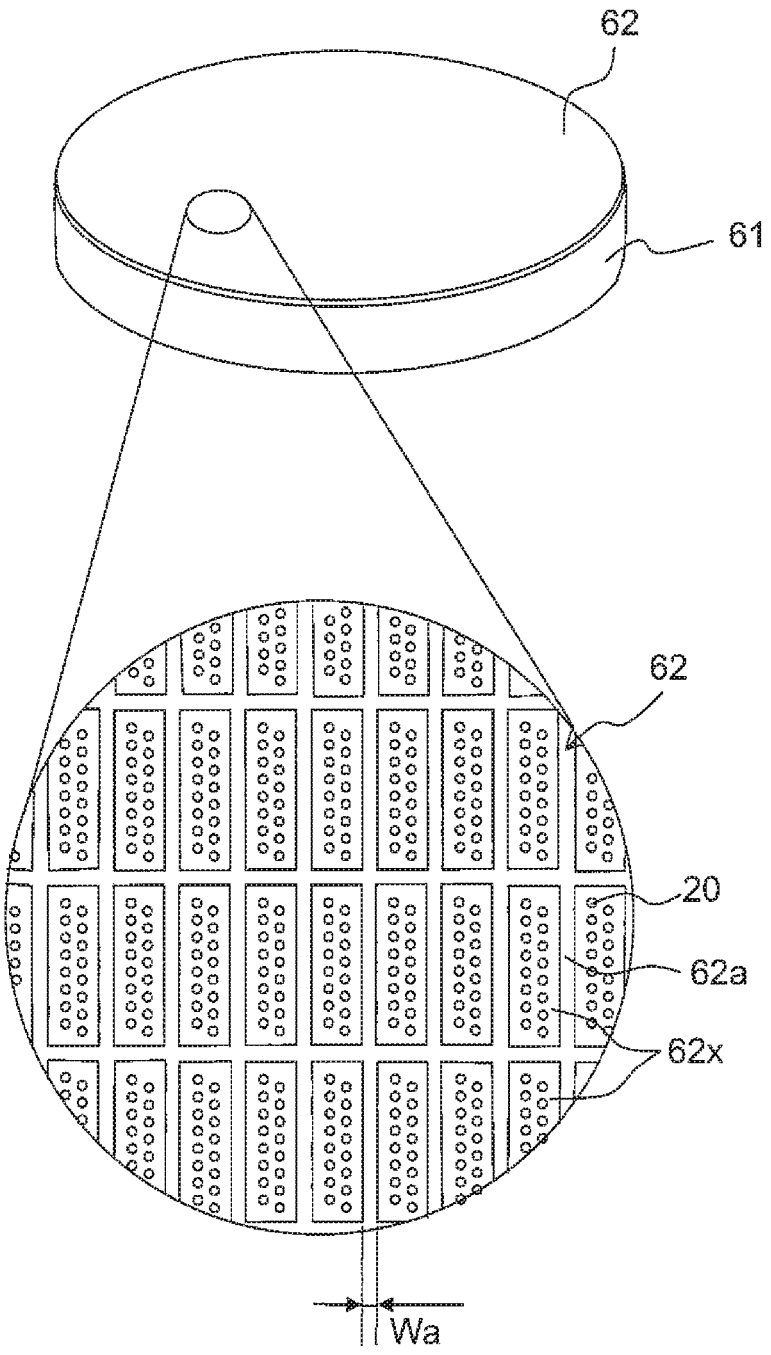
FIG. 11 includes a perspective view of the substrate on which the resist film is formed, and an enlarged view of part of the resist film on a surface of the substrate.

FIG. 11 includes a perspective view of the substrate on which the resist film 62 is formed, and an enlarged view of part of the resist film 62 on a surface of the substrate. After forming the resist film 62 on the substrate 61, as depicted in FIG. 11, grooves 62*a* are formed in the resist film 62 to form partitions each according to a predetermined area corresponding to one head unit 16. Further, although it is possible to form the grooves 62*a* of the resist film 62 simultaneously with the forming of the nozzles 20 by way of the exposure and development of FIGS. 7C and 7D, the nozzles 20 may be formed through another step. After the step of exposing the substrate 61 in FIG. 7C and the step of nozzle forming by way of development in FIG. 7D, one part 62*x* of the resist film 62 partitioned by the grooves 62*a* becomes the nozzle forming film 23 of one head unit 16. An explanation will be made later on the reason for preforming the grooves 62*a* in the resist film 62.

Figure 7E:
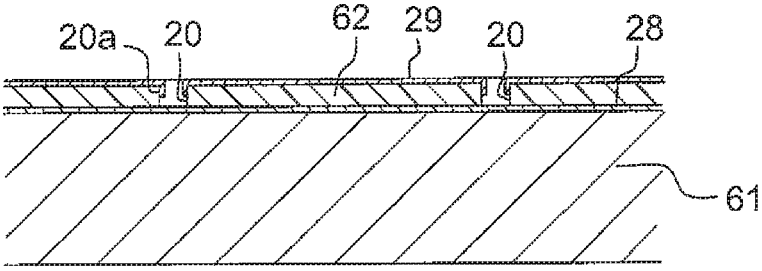

After forming the nozzles 20 in the resist film 62, as depicted in FIG. 7E, the liquid repellent film 29 is formed next by applying a water repellent material such as fluorine resin or the like to the surface of the resist film 62. Further, because the liquid repellent film 29 is formed after the nozzles 20 are formed in the resist film 62, part of the water repellent material flows into the nozzles 20 such that the liquid repellent film 29 is also formed on parts of the inner surfaces of the nozzles 20. A later step is carried out to remove such parts 29*a* of the liquid repellent film 29 as adherent to the inner surfaces of the nozzles 20 (see FIGS. 9B and 9C).

Forming the liquid repellent film 29 is not limited to any particular method. For example, it is possible to adopt the spin coating method which is an ordinary method for forming organic films. However, in a spin coating process, there are cases that a larger amount of the liquiform liquid repellent material may flow into the nozzles 20 such that it becomes difficult to remove the same later on. From this point of view, it is possible to form the liquid repellent film 29 by the spray coating method. In a spray coating process, because there is a smaller amount of the liquid repellent material flowing into the nozzles 20 than in a spin coating process, it is easy to remove the same in a later step. Further, by the spray coating method, it is possible to form the liquid repellent film 29 to be thin and at a uniform thickness. Otherwise, the liquid repellent film 29 may be formed by the transfer method.

After finishing the forming of the nozzles 20 in the resist film 62 and the forming of the liquid repellent film 29, the next steps are carried out to abrade the substrate 61 and form the channel holes 27. Further, from FIG. 8A, the main process is carried out from the surface of the substrate 61 on the opposite side from the resist film 62. In contrast to FIGS. 7A to 7E, therefore, the substrate 61 is turned upside down in FIGS. 8A to 8D as well as in the following figures.

Figure 8A:
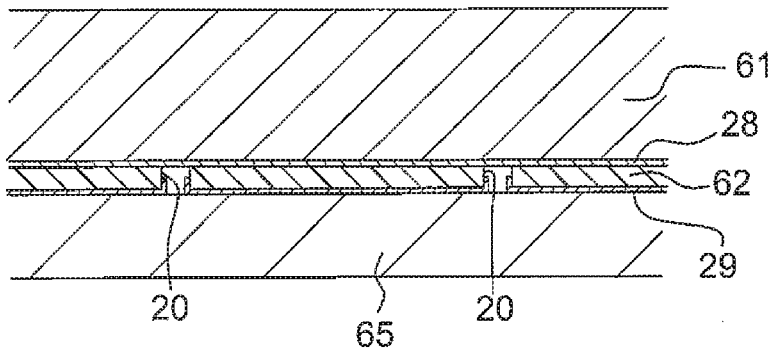
Figure 8B:
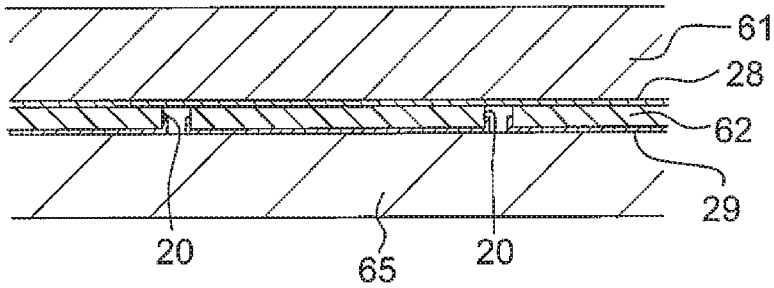

First, as depicted in FIG. 8A, a support member 65 is joined to the resist film 62 formed on the substrate 61. Next, as depicted in FIG. 8B, the substrate 61 is thinned by abrading the surface of the substrate 61 on the opposite side from the resist film 62. A silicon wafer used for forming the substrate 61 is generally as thick as about 500 μm to 700 μm but, in this abrasion step, the substrate 61 is thinned to, for example, 200 μm. In this manner, after abrading and thinning the silicon substrate 61 to a predetermined thickness, it is possible to form the channel holes 27 into a predetermined shape (at a predetermined length) in the substrate 61 by etching the substrate 61 later on. Further, by abrading the substrate 61 after joining the support member 65 to the substrate 61, it is possible for the support member 65 to reinforce the rigidity of the substrate 61 thinned due to the abrasion, thereby facilitating the handling of the substrate 61 thereafter.

Further, when joining the support member 65 to the resist film 62, if a liquiform adhesive is used, then more of the adhesive will flow into the nozzles 20, thereby making it difficult to remove the same later on. Therefore, it is possible to join the support member 65 to the resist film 62 with an adhesive sheet. In this manner, by using the adhesive sheet, the adhesive is less likely to come into the nozzles 20. Further, in order to detach the support member 65 later from the resist film 62 (see FIG. 9E), it is possible to use an adhesive easy to detach such as adhesive sheets of UV detachable type and the like.

Figure 8C:
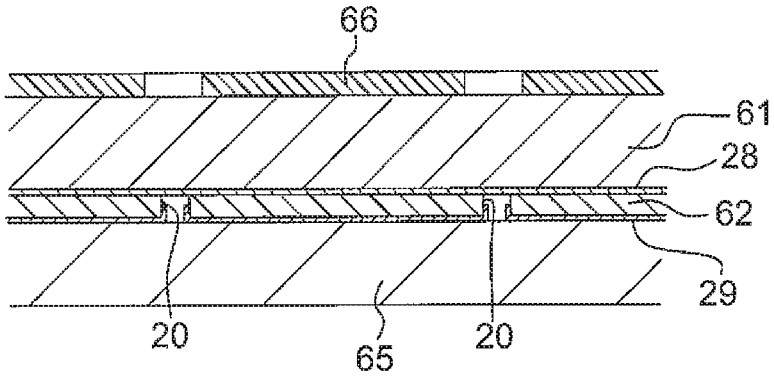
Figure 8D:
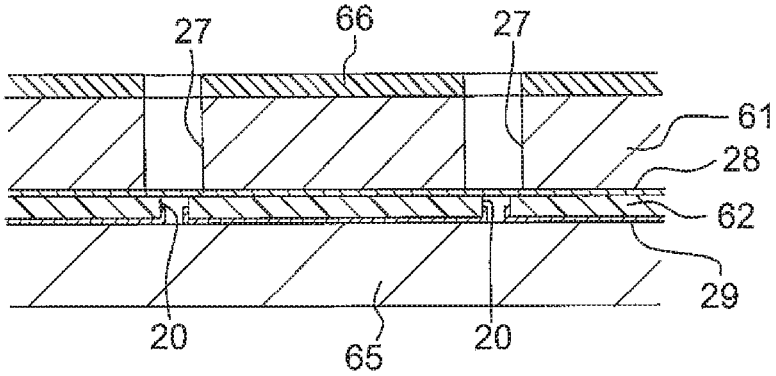

Next, as depicted in FIG. 8C, a mask 66 is formed of a photoresist on the surface of the substrate 61 on the opposite side from the resist film 62. In particular, by spin coating or the like to apply the photoresist to the substrate 61 and then carrying out an exposure process and a development process, the mask 66 is formed to cover other parts of the substrate 61 than those to form the channel holes 27. Then, as depicted in FIG. 8D, by removing such parts of the substrate 61 as not covered by the mask 66 by way of dry etching, the channel holes 27 are formed in the substrate 61.

Further, in this embodiment, before forming the resist film 62, the inorganic film 28 is formed on the substrate 61 (see FIG. 7B). By virtue of this, as depicted in FIG. 8D, when forming the channel holes 27 in the substrate 61 by way of etching from the opposite side from the resist film 62, because the inorganic film 28 functions as an etching stopper, it is possible to prevent the resist film 62 from being removed when the channel holes 27 are formed through the etching.

Figure 9A:
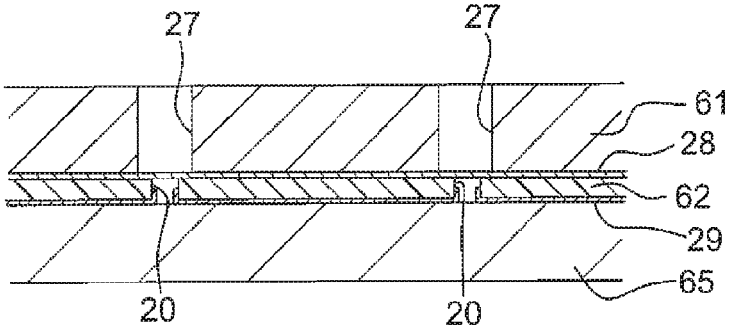

After forming the channel holes 27 in the substrate 61, as depicted in FIG. 9A, the mask 66 of photoresist is removed by way of oxygen plasma. The oxygen plasma has a strong oxidation power, and thus it is possible to decompose and remove organic substances such as resists and the like. However, when the oxygen plasma is used to remove the mask 66 of photoresist, other parts than the mask 66 may also be removed or lessened. The likelihood to be lessened differs with the material, and the silicon substrate 61 is less likely to be lessened while the resist film 62 beyond the channel holes 27 is more likely to be lessened. In this regard, because in this embodiment the inorganic film 28 formed on the substrate 61 seals the channel holes 27 to keep anything from getting beyond, thereby preventing the resist film 62 from being lessened when the mask 66 is removed with the oxygen plasma.

Figure 9B:
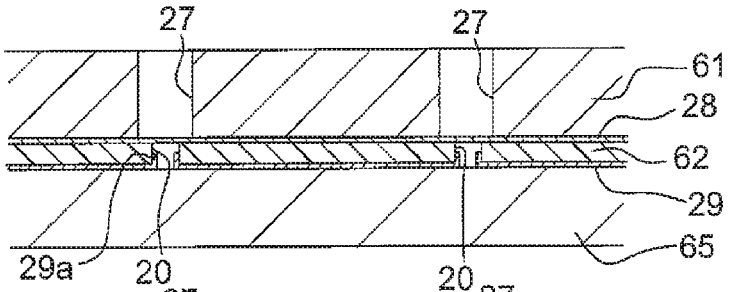
Figure 9C:
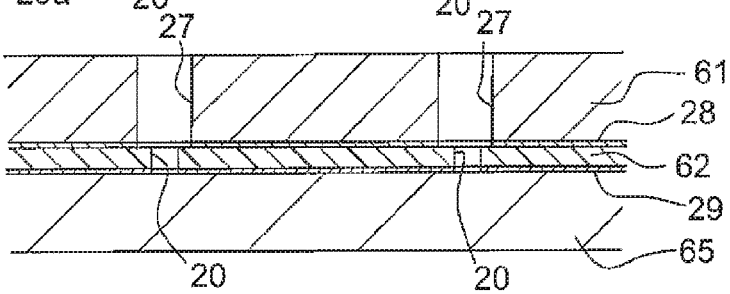

After removing the mask 66, as depicted in FIG. 9B, the inorganic film 28 blocking the channel holes 27 is removed by way of dry etching so as to allow communication between the channel holes 27 and the nozzles 20. Further, as depicted in FIG. 9C, the parts 29*a* of the liquid repellent film 29 adhering to the inner surfaces of the nozzles 20 are removed. It is possible to remove the liquid repellent film 29 by such a method as through an oxygen plasma process, UV ozone process, ion etching, or the like. Further, when removing the liquid repellent film 29 inside the nozzles 20, the support member 65 joined to the resist film 62 covers the liquid repellent film 29 on the surface of the resist film 62. Therefore, when removing the liquid repellent film 29 inside the nozzles 20 by the method such as the oxygen plasma or the like, the liquid repellent film 29 on the surface of the resist film 62 is prevented from being removed together.

Figure 9D:
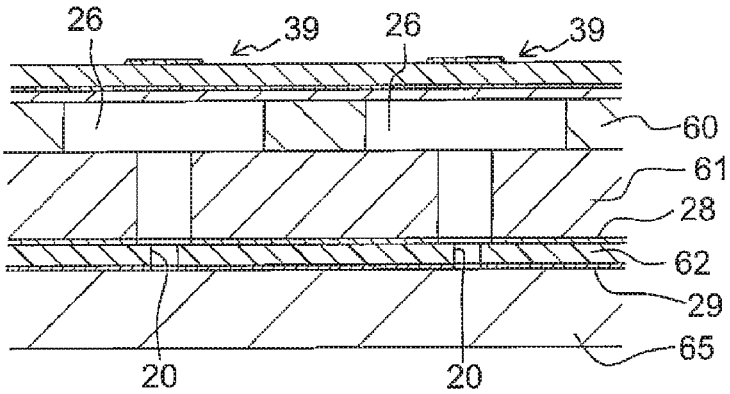
Figure 9E:
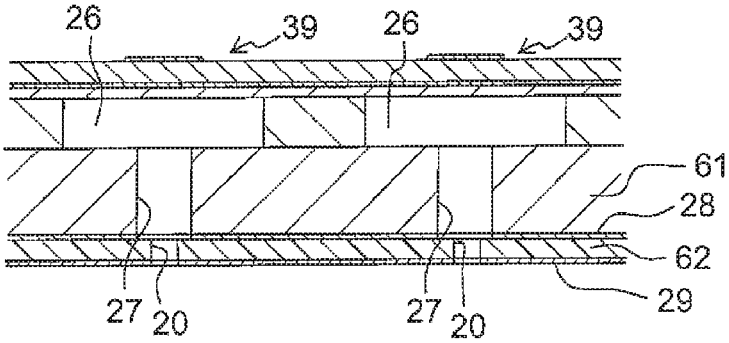

After finishing the above steps, as depicted in FIG. 9D, another step is carried out to join the silicon substrate 60, where the pressure chambers 26 are formed and the piezoelectric elements 39 are formed as films, to the surface of the substrate 61 on the opposite side from the resist film 62. Further, if the reservoir forming member 25 is formed of a silicon substrate, then the silicon substrate for forming the reservoir forming member 25 may also be joined to the substrate 60 on the opposite side from the substrate 61 (on the side of the piezoelectric actuator 24). After joining the substrates 60 and 61, as depicted in FIG. 9E, the support member 65 is detached from the resist film 62.

Figure 12:
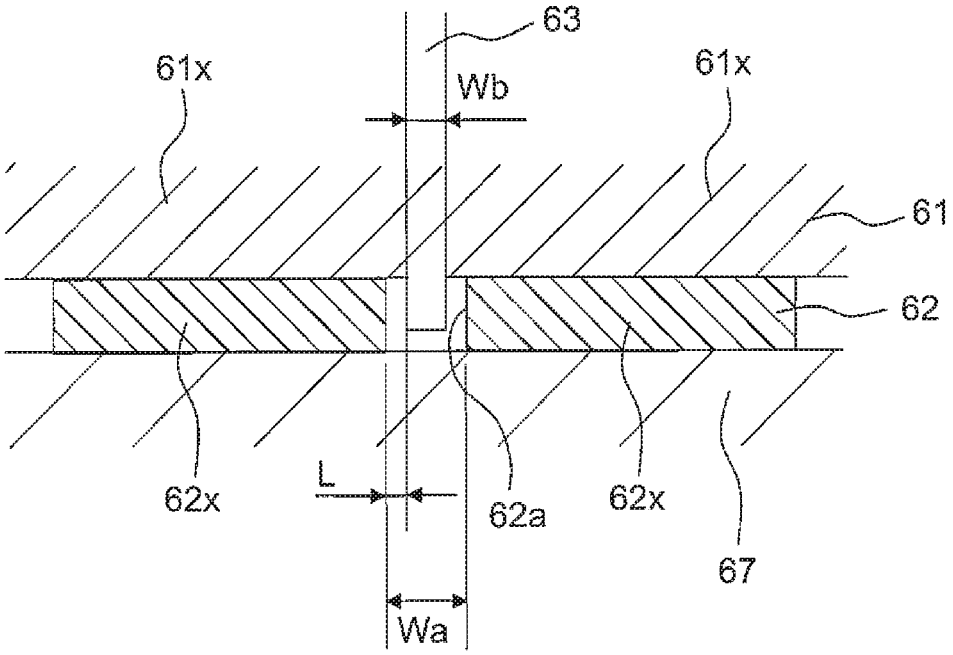
FIG. 12 is an explanatory diagram for a step of singulating the substrate.

After joining the two substrates 60 and 61, these two substrates 60 and 61 are singulated and separated into the plurality of head units 16. As depicted in FIG. 12, the two substrates 60 and 61 are placed on a singulation stage 67. In this state, the singulation blade 63 singulates the two substrates 60 and 61 from above.

Here, if the resist film 62 is linked between a plurality of parts 61*x* of the substrate 61 corresponding respectively to the plurality of head units 16, then when the substrate 61 is singulated with the singulation blade 63, the resist film 62 is liable to be detached from the substrate 61. In contrast to this, the grooves 62*a* are formed in the resist film 62 in this embodiment and, by the grooves 62*a*, the resist film 62 is partitioned into the plurality of parts 62*x* corresponding respectively to the plurality of head units 16. Hence, the resist film 62 is less likely to be detached in singulating the substrate 61.

However, if the width Wa of the grooves 62*a* is smaller than the width Wb of the singulation blade 63, then the resist film 62 may be caught on the singulation blade 63 singulating the substrate 61 such that the resist film 62 becomes more likely to be detached from the substrate 61. The width Wb of the singulation blade 63 can be as small as 50 μm or so. Therefore, it is preferable for the width Wa of the grooves 62*a* to be 70 μm or more which is a little greater than the width Wb of the singulation blade 63. On the other hand, if the width Wa of the grooves 62*a* is too great, then in abrading the substrate 61, etc., the substrate 61 is liable to bend and break between any two of the parts 62*x* of the resist film 62 arranged to interpose one of the grooves 62*a*. Considering these factors, it is possible to let the width Wa of the grooves 62*a* be 70 μm to 200 μm.

Further, because the singulation blade 63 singulates the substrate 61 at the positions of the grooves 62*a*, in each of the separated head units 16, the outer edge of the nozzle forming film 23 is arranged inside of the outer edge of the second channel substrate 22 by the distance L (see FIG. 4). If the distance L is long, then the substrate 61 is wastefully larger than the resist film 62, which is a problem from the point of view of downsizing the head units 16. However, as described above, it is necessary to let the width Wd of the grooves 62*a* be a little greater than the width Wb of the singulation blade 63. Therefore, it is possible to let the above distance L be 10 to 20 μm.

As explained above, in this embodiment, after forming the resist film 62 on the silicon substrate 61, the nozzles 20 are formed in the resist film 62 by exposing and developing the resist film 62. The photoresist for forming the resist film 62 is a significantly less expensive material than silicon. Further, it is possible to form a high precision pattern for the nozzles 20 at low cost by way of ordinarily performed exposure and development in a semiconductor process. Therefore, when forming the nozzles 20 at a narrow or small pitch, it is still possible to form the respective nozzles 20 with high precision while keeping down the cost. Especially in this embodiment, it is possible to form the plurality of piezoelectric elements 39 at an extraordinarily small pitch through film forming. In response to that, the plurality of nozzles 20 are also arrayed at a small pitch of 200 dpi or above. Therefore, the respective nozzles 20 need to be formed with high precision and, in such cases, the above method is particularly preferred.

In the embodiment explained above, the head units 16 correspond to the "liquid jet apparatus" of the present teaching. The first channel substrate 21 or the unseparated substrate 60 corresponds to the "channel member" of the present teaching.

Next, explanations will be made on several modifications which have applied various changes to the above embodiment. However, the same reference numerals are assigned to the components identical or similar in configuration to those in the above embodiment, and any explanation therefor will be omitted.

Figure 13A:
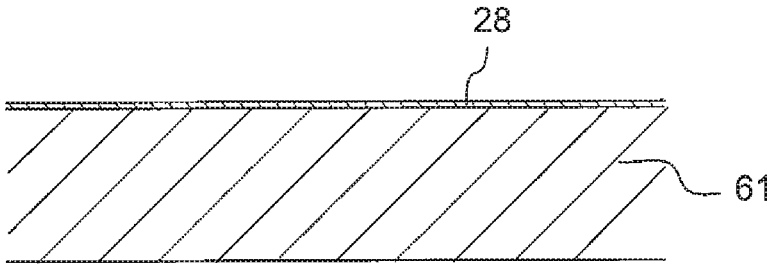
Figure 13B:
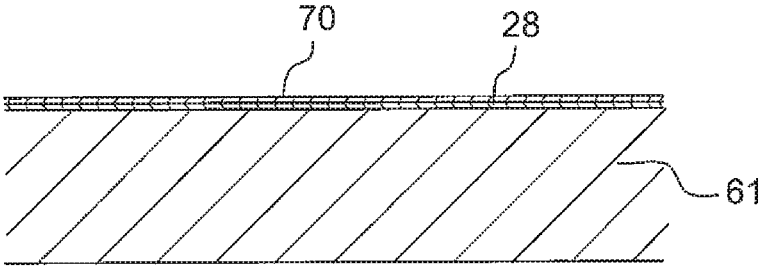
Figure 13C:
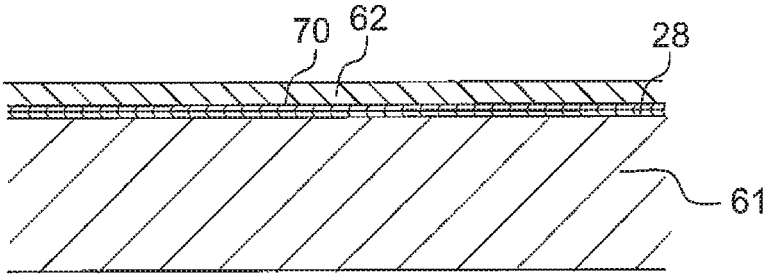
Figure 13D:
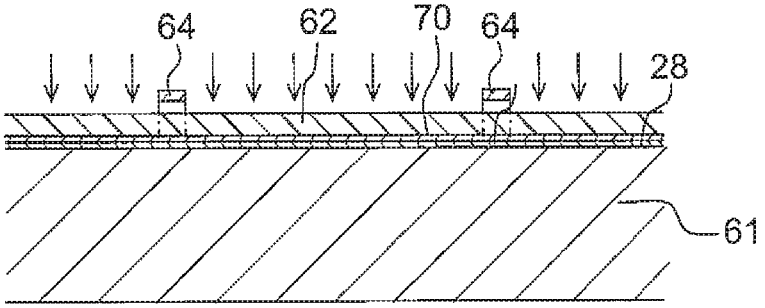
Figure 13E:
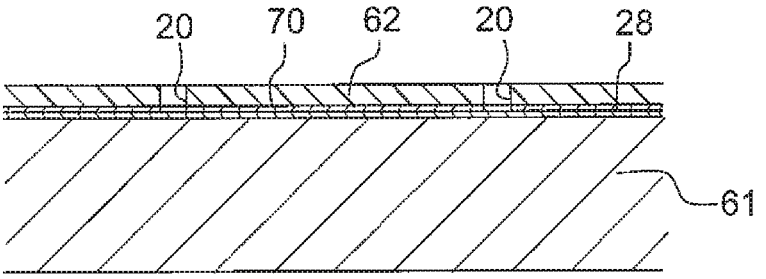

In order to improve the adhesion between the substrate 61 and the resist film 62, before the resist film 62 is formed, a thin cohesive film 70 may be formed with the substrate 61 on the surface of the substrate on which the resist film 62 will be formed later on. After forming the inorganic film 28 on the substrate 61 as depicted in FIG. 13A, the cohesive film 70 is formed on the inorganic film 28 as depicted in FIG. 13B. Thereafter, the resist film 62 thicker than the cohesive film 70 is formed on the cohesive film 70. Because the cohesive film 70 thinner than the resist film 62 is present between the silicon substrate 61 and the resist film 62, the adhesion is improved between the resist film 62 and the substrate 61. Further, while the cohesive film 70 is not limited to any particular material, it is possible to use photoresists. If the cohesive film 70 is also formed of a photoresist as with the resist film 62, then in forming the nozzles 20 by way of exposure (FIG. 13C) and development (FIG. 13D), it is possible to simultaneously remove the cohesive film 70 positioned below the parts of the resist film 62 to form the nozzles 20. Further, it is also possible to form the cohesive film 70 and the resist film 62 with the same type of photoresist.

Further, other steps may be carried out, respectively, to expose and develop the resist film 62 and to expose and develop the cohesive film 70. In such cases, it is possible for the hole diameter of openings of the cohesive film 70 to be larger than the diameter of the nozzles 20 of the resist film 62 but smaller than that of the channel holes 27 of the second channel substrate 22. By virtue of this, the inks are less likely to be hindered from flowing from the channel holes 27, passing through the cohesive film 70, and reaching the nozzles 20.

In the above embodiment as depicted in FIGS. 7A to 7E, after forming the inorganic film 28 on the substrate 61, the resist film 62 is formed thereon. However, forming of the inorganic film 28 may be omitted. In such a case, it is still possible to let the resist film 62 not be lessened by controlling the etching for forming the channel holes 27 in the substrate 61.

The liquid repellent film 29 need not necessarily be formed on the entire resist film 62 (the nozzle forming film 23) but may be formed only on a circumferential area of the nozzles 20. For example, a water repellent material may be applied by way of using a shadow mask or the like to carry out the patterning. In this manner, if the liquid repellent film 29 is formed only in a partial area of the resist film 62, then the adhesion increases when the support member 65 is joined to the resist film 62 as depicted in FIG. 8A.

In the above embodiment as depicted in FIG. 8A, after joining the support member 65 to the substrate 61, the succeeding steps such as the abrasion and the like are carried out. However, if the abraded member is comparatively thick, then it is also possible to omit the joining of the support member 65.

The embodiment and its modifications explained above have applied the present teaching to an ink jet printer configured to print image and the like by jetting ink to recording paper. However, it is also possible to apply the present teaching to any liquid jet apparatuses used for various purposes other than printing image and the like. For example, it is also possible to apply the present teaching to liquid jet apparatuses and the like for industrial use which jet an electroconductive liquid to a substrate to form an electroconductive pattern on a surface of the substrate.

What is claimed is:

1. A method for manufacturing a liquid discharge apparatus comprising:

forming a photoresist film made of a photoresist on a substrate;

exposing the photoresist film;

forming a nozzle in the photoresist film by exposing the photoresist film and then developing the photoresist film;

forming a channel hole in communication with the nozzle by carrying out an etching process from a surface of the substrate on the opposite side from the photoresist film after forming the nozzle; and joining a channel member to the surface of the substrate on the opposite side from the photoresist film, the channel member including a pressure chamber in communication with the channel hole and a piezoelectric element formed as a film to correspond to the pressure chamber.

2. The method for manufacturing the liquid discharge apparatus according to claim 1, further comprising:

joining a support member to the photoresist film formed on the substrate after forming the nozzle; and thinning the substrate by abrading the surface of the substrate on the opposite side from the photoresist film after joining the support member, wherein the channel hole is formed after the substrate is abraded.

3. The method for manufacturing the liquid discharge apparatus according to claim 2, wherein an adhesive sheet is used to join the support member to the photoresist film.

4. The method for manufacturing the liquid discharge apparatus according to claim 2, further comprising:

forming a water repellent film on the photoresist film after forming the nozzle; and removing a part of the water repellent film as adherent to an inner surface of the nozzle with the support member joined to the photoresist film after forming the channel hole, by one of methods of oxygen plasma, UV ozone processing, and ion etching.

5. The method for manufacturing the liquid discharge apparatus according to claim 4, wherein the water repellent film is formed by way of spray coating.

6. The method for manufacturing the liquid discharge apparatus according to claim 4, wherein before the photoresist film is formed, an inorganic film containing an inorganic silicon compound is formed on such a surface of the substrate as to form the photoresist film thereon later.

7. The method for manufacturing the liquid discharge apparatus according to claim 6, wherein a mask is formed of a photoresist on the surface of the substrate on the opposite side from the photoresist film, and then the channel hole is formed by etching and removing a part of the substrate not covered by the mask the method further comprising: removing the mask of the photoresist by way of oxygen plasma after forming the channel hole, and etching and removing a part of the inorganic film blocking the channel hole after removing the mask, wherein the water repellent film is removed after the inorganic film is removed.

8. The method for manufacturing the liquid discharge apparatus according to claim 1, further comprising:

forming grooves to partition the photoresist film into a plurality of parts, wherein in forming the nozzle, the nozzle is formed in each of the plurality of parts of the photoresist film partitioned by the grooves; and after the nozzles are formed, the substrate is singulated and separated at such positions as formed with the grooves.

9. The method for manufacturing the liquid discharge apparatus according to claim 8, wherein a width of the grooves is within a range from 70 μm to 200 μm.

10. The method for manufacturing the liquid discharge apparatus according to claim 1, wherein a negative photosensitive resist is used to form the photoresist film.

11. The method for manufacturing the liquid discharge apparatus according to claim 1, wherein a chemically amplified resist is used to form the photoresist film.

12. The method for manufacturing the liquid discharge apparatus according to claim 1, further comprising forming a cohesive film on such a surface of the substrate so as to form the photoresist film thereon later, before forming the photoresist film, wherein, in forming the photoresist film, the photoresist film is formed on the cohesive film to be thicker than the cohesive film.

13. The method for manufacturing the liquid discharge apparatus according to claim 12, wherein the cohesive film is formed of a photoresist.

14. The method for manufacturing the liquid discharge apparatus according to claim 1, wherein in forming the nozzle, the nozzle is formed in the photoresist film to include a plurality of nozzles arrayed at a pitch of 200 dpi or more.

15. A liquid discharge apparatus configured to discharge liquid comprising:

a substrate in which a channel hole is formed;

a first film arranged on the substrate;

a second film made of a photoresist and arranged on the first film, the second film being formed with a nozzle in communication with the channel hole;

a channel member including a pressure chamber in communication with the channel hole, and joined to a surface of the substrate on a side opposite from the second film; and a piezoelectric element formed in the channel member to correspond to the pressure chamber.

16. The liquid discharge apparatus according to claim 15, wherein an outer edge of the second film is arranged 10 to 20 μm inside of an outer edge of the substrate.

17. The liquid discharge apparatus according to claim 15, wherein the channel member is a silicon member.

18. The method for manufacturing the liquid discharge apparatus according to claim 1, wherein the substrate is a silicon substrate.

19. The liquid discharge apparatus according to claim 15, wherein the substrate is a silicon substrate.

20. The liquid discharge apparatus according to claim 15, wherein the first film contains an inorganic compound.

21. The liquid discharge apparatus according to claim 15, wherein the first film has a thickness of 1 μm or less.

22. A liquid discharge apparatus configured to discharge liquid comprising:

a silicon substrate in which a channel hole is formed:

a film made of a photoresist, arranged on the substrate, and formed with a nozzle in communication with the channel hole;

a channel member which includes a pressure chamber in communication with the channel hole, and is joined to a surface of the substrate on the opposite side from the film; and a piezoelectric element formed in the channel member to correspond to the pressure chamber, wherein an outer edge of the resist film is arranged 10 to 20 μm inside of an outer edge of the substrate.

* * * * *